US010441871B2

(12) United States Patent
Yi

(10) Patent No.: US 10,441,871 B2
(45) Date of Patent: Oct. 15, 2019

(54) SNOW SLIDING DEVICE

(71) Applicant: Ji Ha Yi, Seoul (KR)

(72) Inventor: Ji Ha Yi, Seoul (KR)

( * ) Notice: Subject to any disclaimer, the term of this patent is extended or adjusted under 35 U.S.C. 154(b) by 0 days.

(21) Appl. No.: 16/083,690

(22) PCT Filed: Feb. 21, 2018

(86) PCT No.: PCT/KR2018/002095

§ 371 (c)(1),
(2) Date: Sep. 10, 2018

(87) PCT Pub. No.: WO2018/155887

PCT Pub. Date: Aug. 30, 2018

(65) Prior Publication Data

US 2019/0070482 A1 Mar. 7, 2019

(30) Foreign Application Priority Data

Feb. 21, 2017 (KR) ..... 10-2017-0023135

(51) Int. Cl.
*A63C 5/04* (2006.01)
*A63C 5/052* (2006.01)
*A63C 5/048* (2006.01)

(52) U.S. Cl.
CPC ..... *A63C 5/052* (2013.01); *A63C 5/048* (2013.01); *A63C 5/0422* (2013.01)

(58) Field of Classification Search
CPC .. A63C 5/02; A63C 5/044; A63C 5/16; A63C 2203/065; A63C 7/00; A63C 7/02; A63C 7/04
See application file for complete search history.

(56) References Cited

U.S. PATENT DOCUMENTS 8,746,728 B2 * 6/2014 Shute ..... A63C 7/1013 280/607
2004/0213960 A1 * 10/2004 Riepler ..... A63C 5/003 428/156

FOREIGN PATENT DOCUMENTS

KR 10-2005-0069226 A 7/2005
KR 20-0445532 Y1 8/2009
KR 10-2014-0057461 A 5/2014
KR 10-2016-0001956 A 1/2016
WO 2008-086620 A1 7/2008

* cited by examiner

*Primary Examiner* — Bryan A Evans

(74) *Attorney, Agent, or Firm* — Novick, Kim & Lee, PLLC; Jae Youn Kim

(57) ABSTRACT

A snow sliding device includes a first end body on which one end of a boot is caught, a second end body provided on the opposite side of the first end body and on which the other end of the boot is caught, and a main body which is provided between the first end body and the second end body to connect the first end body to the second end body, and in which an edge surface facing the ground can be changed and selectively used. In the snow sliding device according to the present invention, an edge may be replaced from a deck or another surface of the main body may be used as the edge. Thus, when the edge is worn down, the edge may be replaced or another surface may be used.

11 Claims, 7 Drawing Sheets

SNOW SLIDING DEVICE

TECHNICAL FIELD

The present invention relates to a snow sliding device and, more particularly, to a snow sliding device having a replaceable edge blade that can slide on snow.

BACKGROUND ART

Typical sports equipment enabling a user to slide on snow is skis and snowboards. In the case of skis, a user wears skis on both feet, and changes directions using the skis and ski poles. A snowboard is a single deck on which a user slides on snow with both feet placed on the deck.

Recently, equipment such as ski boards on which a person places both feet without ski poles as on a snowboard has been developed and used. Among such equipment, relatively short-length equipment such as ski-boards or snowboards has gained much popularity in recent years, since more various maneuvers can be performed.

However, when snow sliding devices are used for a long time or during an action of sliding on an object, the snow sliding devices may be damaged, which is problematic. More specifically, a deck rubbing against an object is abraded by repeated riding. In particular, both sides (edges) of the deck, rubbing against an object, may be concentrically abraded or damaged.

In this case, the entirety of the deck must be replaced, thereby increasing maintenance cost. In addition, the problem of waste is caused, since an undamaged deck center must also be replaced.

DISCLOSURE

Technical Problem

Accordingly, the present invention has been made keeping in mind the above problems occurring in the prior art, and an object of the present invention is to provide a snow sliding device, in which a portion of a deck including an edge can be easily detached from the deck to enable easy replacement.

Technical Solution

According to embodiments of the present invention, a snow sliding device may include: a first end body to which one end of a boot is fastened; a second end body provided opposite the first end body, such that the other end of the boot is fastened to the second end body; and a main body provided between the first end body and the second end body to connect the first end body and the second end body, wherein an edge surface of the main body directed toward the ground is changeable to be selectively used The main body may be configured to be rotatable with respect to the first end body and the second end body, such that the edge surface thereof directed toward the ground is selectively changeable.

The main body may be separably connected to the first end body and the second end body, and when a direction in which the main body is connected to the first end body and the second end body is varied, the edge surface of the main body directed toward the ground is changed.

The main body may have a lower edge block connected thereto, the lower edge block protruding toward the ground, thereby providing an edge surface.

The width of the main body may be narrower than the width of either the first end body or the second end body, such that both side surfaces of the main body are recessed more inwardly than the first end body and the second end body, thereby providing recessed surfaces, to which edge blocks are selectively coupled.

Each of the first end body and the second end body may include a connecting portion connected to the main body and an outer portion perpendicularly extending from the connecting portion, thereby providing either a nose or a tail.

The main body may include a single body or a plurality of separable unit bodies.

The first end body and the second end body may provide a nose and a tail, and may include coupling recesses to which the one and other ends of the boot are fitted, respectively.

The first end body and the second end body may have symmetrical shapes.

At least one of the first end body and the second end body may have a curved surface, a central portion of which protrudes parallel to a longitudinal direction of the snow sliding device.

A guide recess may be provided in an outer surface of at least one of the first end body and the second end body.

Advantageous Effects

The snow sliding device according to the present invention has the following effects.

In the snow sliding device according to the present invention, a portion of a deck including an edge can be detached from the deck and replaced with another portion, or another surface of a body can be used as an edge. When the edge is abraded, the edge portion may be replaced with another one or another surface may be used, thereby increasing the longevity of the snow sliding device. In addition, since a user can select the length, thickness, or the like of an effective edge through replacement of the edge, the operability of the snow sliding device can be improved.

MODE FOR INVENTION

Figure 1:
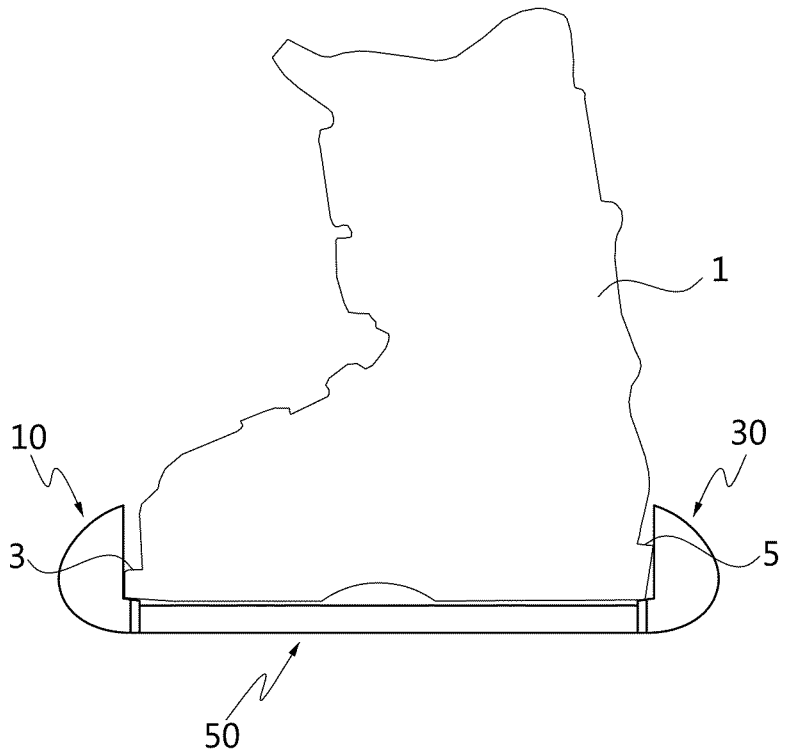
FIG. 1 illustrates an embodiment of the snow sliding device according to the present invention attached to a boot.

Hereinafter, specific embodiments of the present invention will be described in detail with reference to the accompanying drawings. Throughout this document, reference should be made to the drawings, in which the same reference numerals and symbols will be used to designate the same or like components. In the following description of the present disclosure, detailed descriptions of known functions and components incorporated herein will be omitted in the case that the subject matter of the present disclosure may be rendered unclear thereby.

It will also be understood that, while terms such as "first", "second", "A", "B", "(a)", and "(b)" may be used herein to describe various elements, such terms are merely used to distinguish one element from other elements. The substance, sequence, order, or number of such elements is not limited by these terms. It will be understood that when an element is referred to as being "connected to" or "coupled to" another element, not only can it be "directly connected or coupled to" the other element, but it can also be "indirectly connected or coupled to" the other element via an "intervening" element.

Hereinafter, specific embodiments of the snow sliding device according to the present invention, as described above, will be described in more detail with reference to the accompanying drawings.

FIG. 1 illustrates an embodiment of the snow sliding device according to the present invention attached to a boot 1. As illustrated in this drawing, the snow sliding device according to the present invention the boot 1 can be directly attached to without a separate binding means. The snow sliding device according to the present invention may be used as a type of short ski, providing a structure allowing a user to easily and directly attach the boot 1 thereto to ride thereon.

In addition, the snow sliding device according to the present invention is intended to allow a user using the same to easily slide on snow and perform a variety of maneuvers, such as turning and braking. FIG. 1 illustrates the snow sliding device attached to the boot 1. As illustrated in FIG. 1, a front portion 3 and a rear portion 5 of the boot 1 are fitted to the snow sliding device, so that the snow sliding device is integrally attached to the boot 1. In this position, the user can use the snow sliding device on snow as a transport means.

Describing the snow sliding device, the snow sliding device according to the present invention generally includes a first end body 10, a second end body 30, and a main body 50. The main body 50 is provided between the first end body 10 and the second end body 30. Theses bodies 10, 30, and 50 are connected together, thereby providing a single snow sliding device.

Both ends of the boot 1 worn by the user are fastened to the first end body 10 and the second end body 30, respectively. In both ends of the boot 1, one end is fastened to the first end body 10, while the other end is fastened to the second end body 30. When both ends of the boot 1 are fastened to the first end body 10 and the second end body 30, the user can move on snow using the snow sliding device.

The first end body 10 and the second end body 30 include connecting portions 11 and 31 connected to the main body 50 and outer portions 15 and 35 perpendicularly extending from the connecting portion 11 and 31 to form a nose and a tail, respectively. That is, the first end body 10 and the second end body 30 have the nose and the tail, respectively. Each of the first end body 10 and the second end body 30 has a coupling recess 32 into which a corresponding end of both ends of the boot 1 is fitted. Here, the first end body 10 and the second end body 30 may be configured to have symmetrical shapes. For reference, the coupling recess 32 of the first end body 10 is not shown in FIGS. 2 and 3.

In at least one of the first end body 10 and the second end body 30, an outer surface thereof, i.e. the outer portion 15 or 35, is provided in the shape of a curved surface. According to the present embodiment, both the first end body 10 and the second end body 30 have curved outer surfaces. This configuration allows the user, riding on the snow sliding device, to erect the snow sliding device so that the curved outer surface of the first end body 10 or the second end body 30 is brought into contact with the ground. This consequently improves sliding performance and helps the user to glide while performing a variety of maneuvers. For example, a portion of the snow sliding device adjacent to the second end body 30 may be separated from a snow surface, while the outer portion 15 of the first end body 10 is in contact with the snow surface.

According to the present embodiment, the outer portion 15 of the first end body 10 is substantially hemispherical. That is, the central portion of the outer portion 15 of the first end body 10 protrudes in a direction parallel to the longitudinal direction of the snow sliding device. Thus, the outer portion 15 of the first end body 10 has a substantially hemispherical shape. Here, the shape of the outer portion 15 is not necessarily hemispherical, and the outer portion 15 may be configured with a protruding central portion. In addition, the central portion of the outer portion 15 of the first end body 10 does not necessarily protrude most, but the outer portion 15 of the first end body 10 may protrude most in a location aside from the central portion.

A guide recess 18 or 38 is provided in the outer surface of at least one of the first end body 10 and the second end body 30. The guide recesses 18 and 38 may facilitate sliding of the first end body 10 or the second end body 30, when the curved outer surface thereof is in contact with the ground, or allow other components to be connected thereto. The connected components may be a front edge block (not shown) or a variety of Internet of things (IoT) devices, including a light-emitting diode (LED) lamp.

Figure 2:
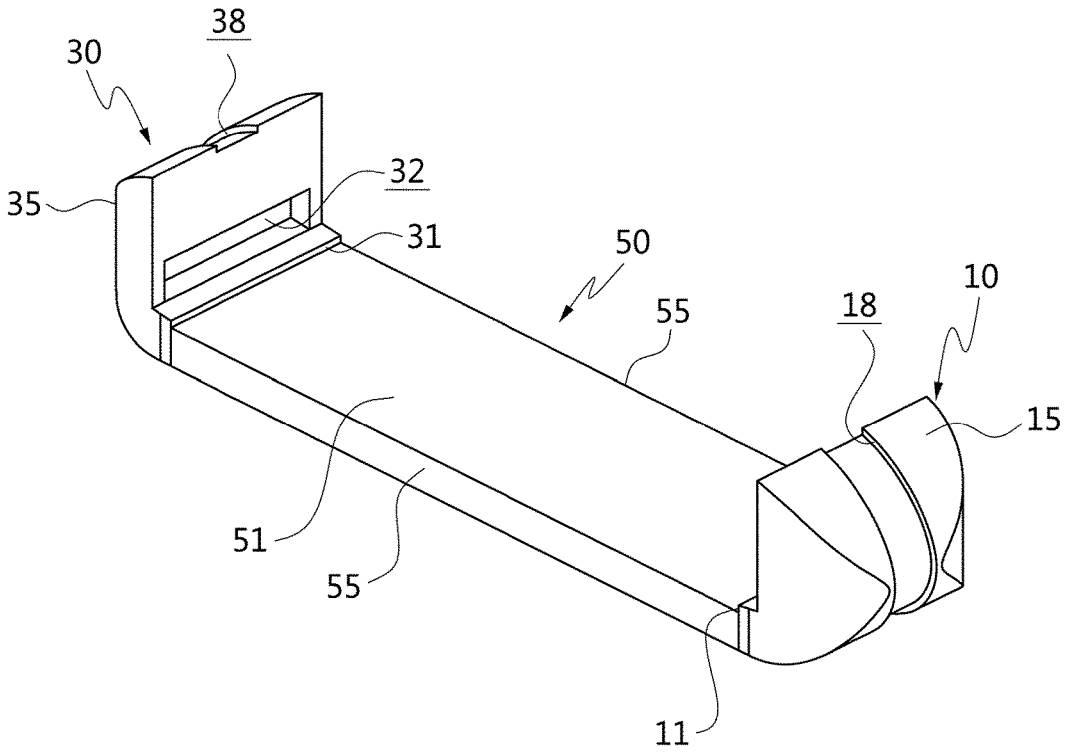
FIG. 2 is a perspective view illustrating a configuration of the embodiment of the snow sliding device according to the present invention.

The guide recesses 18 and 38 extend in the longitudinal direction of the snow sliding device. More specifically, as illustrated in FIG. 2, the guide recesses 18 and 38 extend in a bot-to-bottom direction of the first end body 10. When the first end body 10 is directed toward the snow surface (bottom), the guide recesses 18 and 38 extend in a direction parallel to the longitudinal direction of snow sliding device. This can further improve the sliding performance of the snow sliding device.

The main body 50 is provided between the first end body 10 and the second end body 30. The main body 50 may be regarded as connecting the first end body 10 and the second end body 30. The main body 50 has an edge surface 55 directed toward the snow surface (ground). In addition, one of several edge surfaces 55 of the main body 50 can be selectively used by changing the edge surface of the main body 50 with another edge surface.

Figure 4:
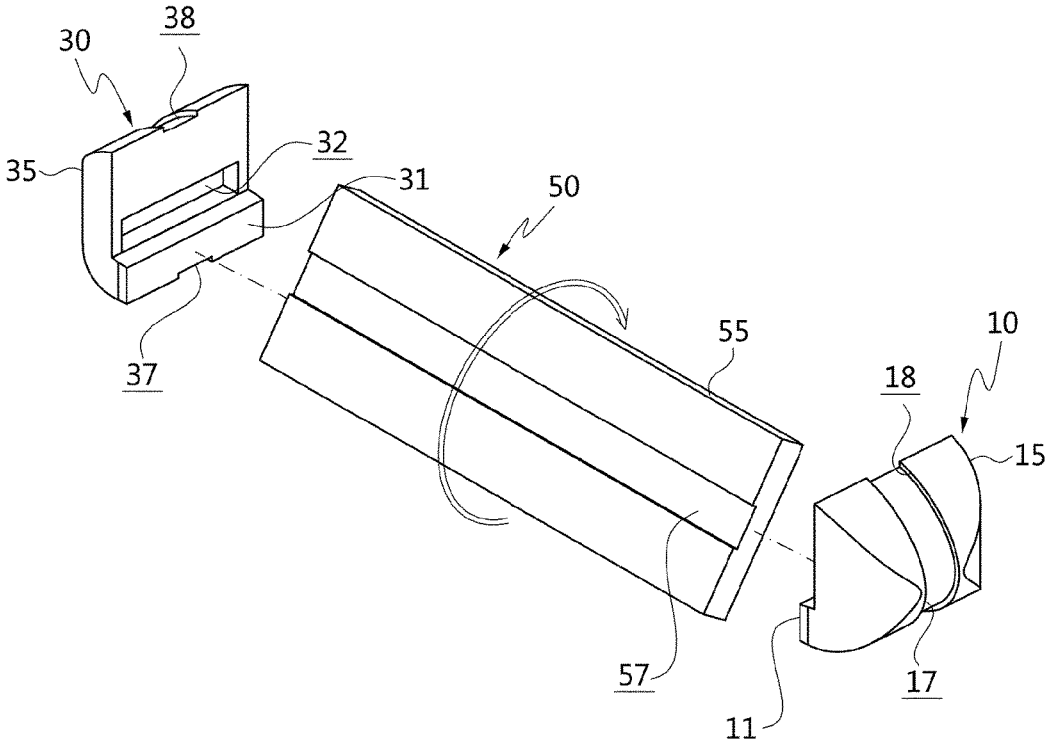
FIG. 4 is a perspective view illustrating a rotated position of the main body of the embodiment in FIG. 2.

The plurality of edge surfaces 55 of the main body 50 can be used through rotation of the main body 50. As illustrated in FIG. 4, when the separated main body 50 is rotated 180°, the opposite surface is directed toward the ground, and the other edge surface 55 can be used. More specifically, the main body 50 is provided to be rotatable with respect to the first end body 10 and the second end body 30 about the axis of rotation extending along a line connecting the first end body 10 and the second end body 30. Reference numeral 51 indicates a top surface of the main body 50.

In this regard, according to the present embodiment, the main body 50 is provided rotatable with respect to the first end body 10 and the second end body 30. Rotation of the main body 50 allows both the top surface and the bottom surface to be used, so that two edge surfaces can be selectively used. Accordingly, when one edge surface is worn, the other edge surface can be used, thereby increasing the longevity of the snow sliding device. In addition, the length, thickness, and the like of an effective edge can be selected by the user through replacement of the edge, thereby improving the operability of the snow sliding device.

The main body 50 is connected to the first end body 10 and the second end body 30 in such a manner that the main body 50 can be separated from the first end body 10 and the second end body 30. When the direction in which the main body 50 is connected to the first end body 10 and the second end body 30 is varied, the edge surface directed toward the ground may be changed. Specifically, since the main body 50 can be completely separated from and then reconnected to the first end body 10 and the second end body 30, the main body 50 may be rotated or replaced by another main body before being reconnected to the first end body 10 and the second end body 30. When the length of another main body is different from the length of the main body 50, the entire length of the snow sliding device is varied.

The main body 50 may be provided as a single body or may be comprised of a plurality of separable unit bodies. When the main body 50 is comprised of the plurality of separable unit bodies, the overall length of the snow sliding device may be varied by varying the number of the unit bodies.

A main guide 57 is provided in the bottom of the main body 50. The main guide 57 is recessed in the bottom, i.e. a bottom surface, of the main body 50. The main guide 57 extends in the longitudinal direction of the main body 50, thereby improving the sliding performance of the snow sliding device. In this regard, the main guide 57 may be provided in a location aligned with connecting recesses 17 and 37 provided in the bottoms of the above-described guide recesses 18 and 38, such that the main guide 57 is continuous with the connecting recesses 17 and 37.

A separate lower plate (not shown) may be connected to the main body 50 of the snow sliding device. The lower plate protrudes toward the ground, thereby providing an edge surface, and is connected to the main guide 57 of the main body 50. The lower plate may be connected to the main body 50 by a variety of methods. For example, the lower plate may be connected to the main body 50 using a fastener, such as a bolt, or may be fitted to the main body 50 by sliding. An edge means may be connected to the main body 50, based on a press-fitting structure.

Figure 5:
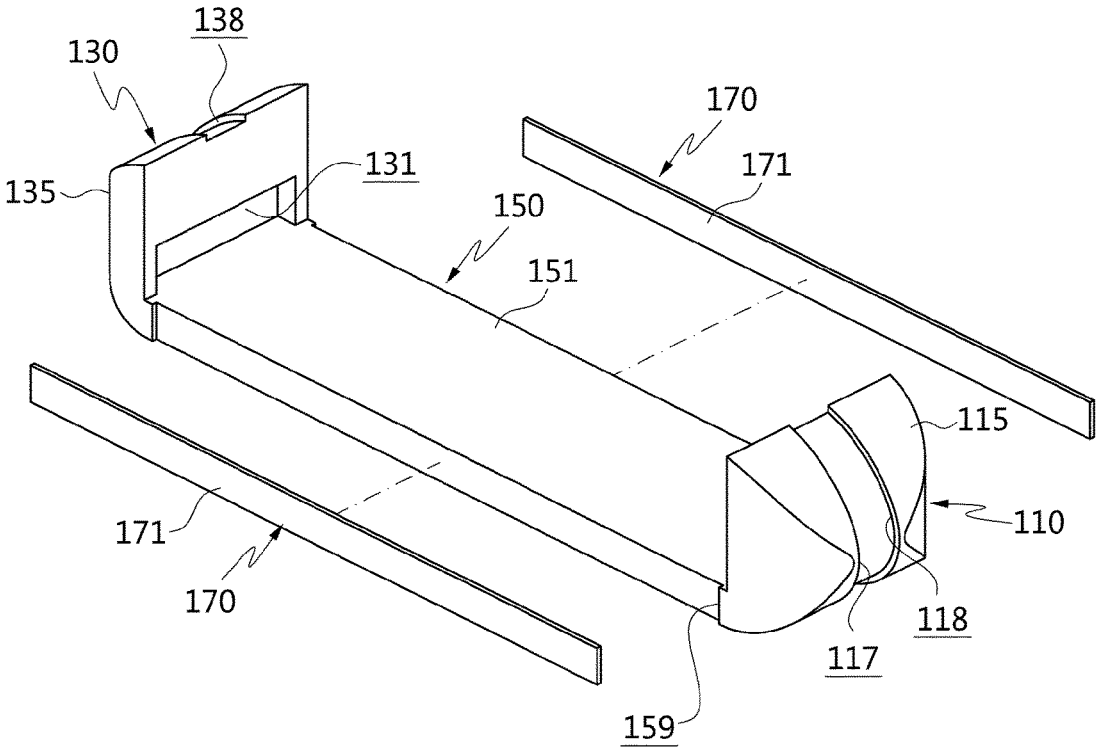
FIG. 5 is a perspective view illustrating a configuration of a second embodiment of the snow sliding device according to the present invention.

FIG. 5 illustrates a second embodiment of the snow sliding device according to the present invention. For reference, descriptions of some features will be omitted when they are the same as those of the above-described embodiment. As illustrated in this drawing, the width of the main body 150 of the snow sliding device may be narrower than the width of either a first end body 110 or a second end body 130. Then, both side surfaces of the main body 150 are recessed more inwardly than the first end body 110 and the second end body 130, thereby forming recessed surfaces, to which separate edge blocks may be coupled. According to the present embodiment, the edge blocks are side edge blocks 170. The side edge blocks 170 are provided in outermost locations of the main body 150, thereby forming edge surfaces supposed to come into contact with the ground.

The side edge blocks 170 extend in the longitudinal direction of the main body 150, and have a low thickness. The top-bottom height of the side edge blocks 170 may be the same or different from the top-bottom height of the main body 150. The top-bottom height of the side edge blocks 170 may be selected differently, depending on the sliding performance of the snow sliding device. The side edge blocks 170 may be connected to the main body 50 using a fastener, such as a bolt, or a variety of other coupling structures, such as a press-fitting structure and a coupling structure having coupling protrusions.

Figure 6:
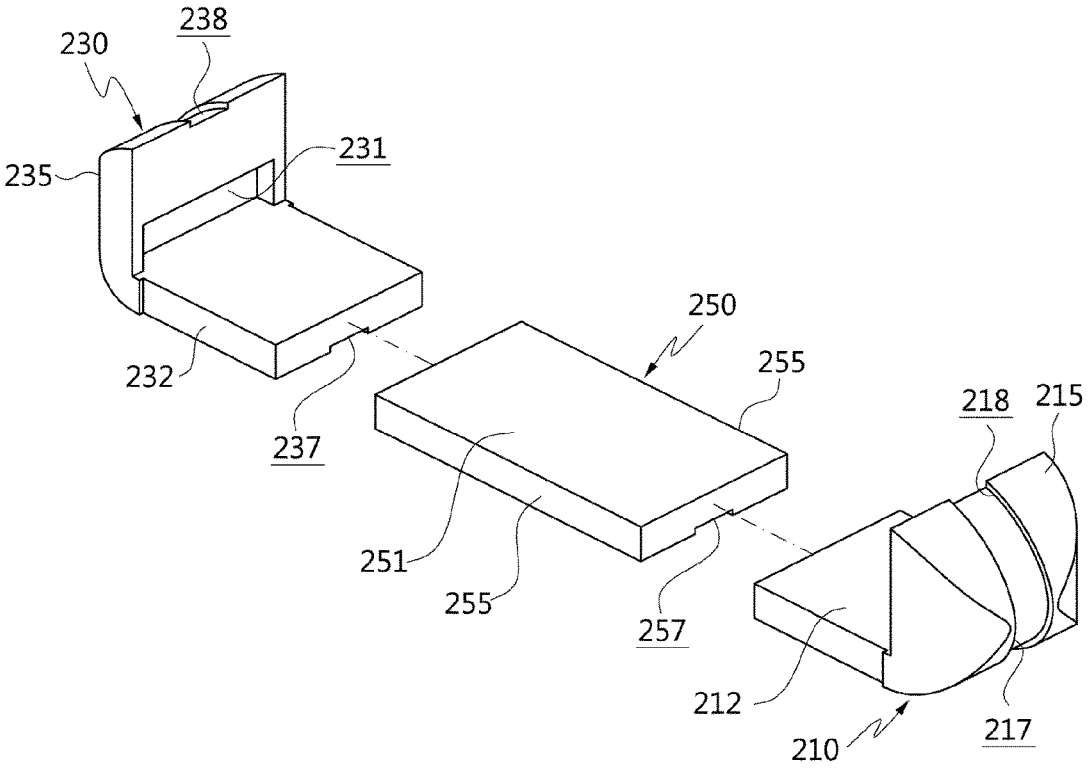
FIG. 6 is a perspective view illustrating a configuration of a third embodiment of the snow sliding device according to the present invention.

FIG. 6 is an exploded perspective view illustrating a third embodiment of the snow sliding device according to the present invention. As illustrated in this drawing, a main body 250 relatively shorter in length than the main body 50 according to either the foregoing embodiment of FIG. 2 or the foregoing embodiment of FIG. 5. The main body 250 is relatively shorter in length, but connecting portions 211 and 231 of first and second end bodies 210 and 230 are provided to be relatively longer. When the lengths of the connecting portions 211 and 231 of the first end body 210 and the second end body 230 are the same as in the embodiment of FIG. 2, the overall length of the snow sliding device may be reduced. The length of the snow sliding device may be changed more variously through replacement of the main body 250.

Figure 7:
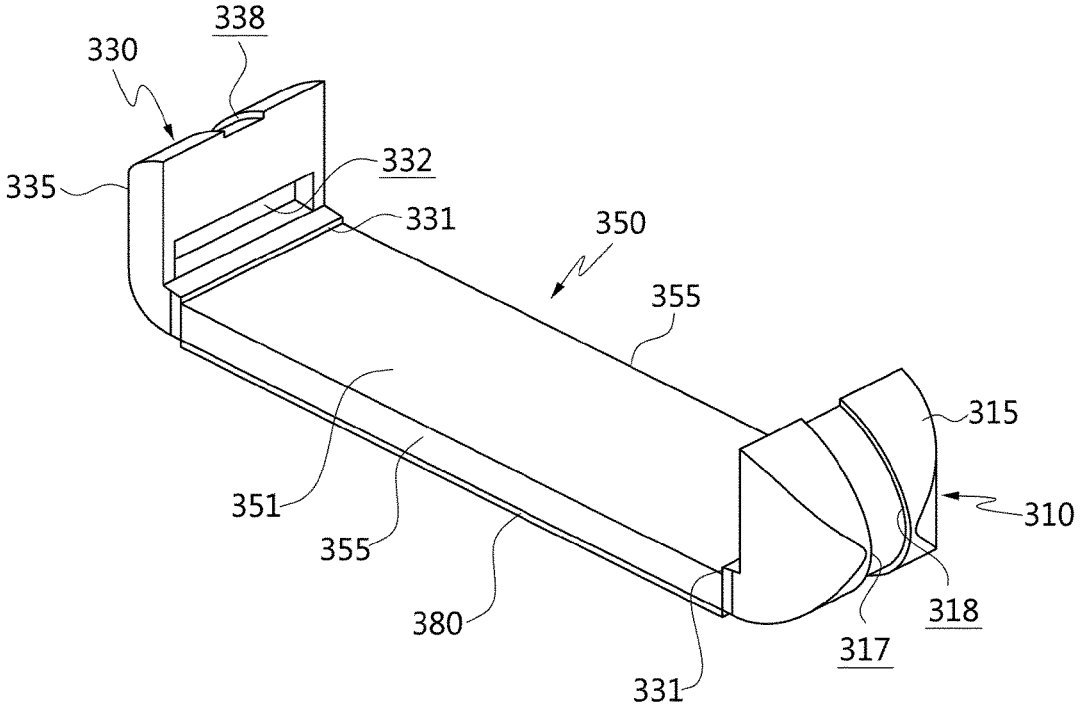
FIG. 7 is a perspective view illustrating a configuration of a fourth embodiment of the snow sliding device according to the present invention.

FIG. 7 illustrates a fourth embodiment of the snow sliding device according to the present invention. According to the present embodiment, an edge block is connected to the bottom, i.e. a bottom surface, of the snow sliding device. In the present embodiment, the edge block is a lower edge block 380. The lower edge block 380 may act to increase the overall height of the snow sliding device while providing an edge surface in the bottom of the main body 350. The lower edge block 380 can be fastened to the bottom of the main body 350 using a fastener or a variety of other methods, such as a slide-fitting method. The lower edge block 380 may have a variety of widths and heights, and may provide sliding performance required by the user through replacement.

Figure 3:
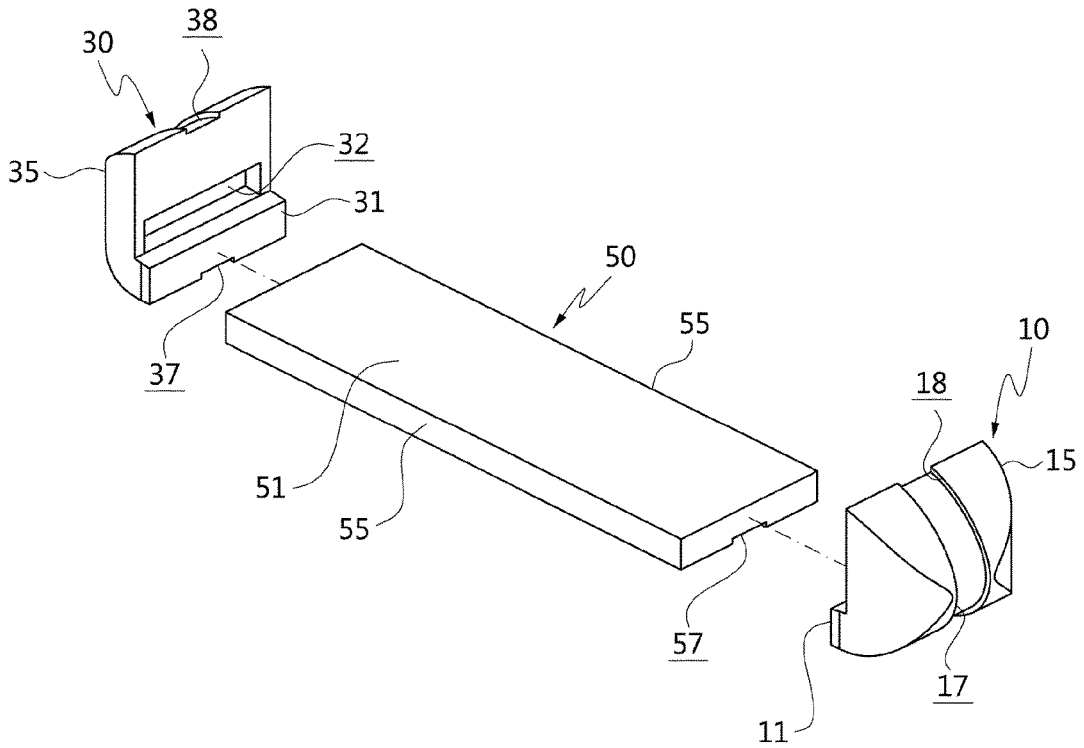
FIG. 3 is an exploded perspective view illustrating components of the embodiment illustrated in FIG. 2.

Hereinafter, a process of using the embodiment illustrated in FIGS. 2 to 4 will be described. First, when a user, gliding on snow using a snow sliding device, intends to replace an edge surface of the snow sliding device, the boot 1 must first be detached from the snow sliding device. When a front portion 3 and a rear portion 5 of the boot 1 are separated from the first end body 10 and the second end body 30, respectively, the boot 1 is detached from the snow sliding device.

In this state, the user separates the first end body 10 and the second end body 30 from the main body 50. Since the first end body 10 and the second end body 30 are connected to the main body 50 using a protrusion coupling structure, a coupling structure using a fastener (e.g. a bolt), a sliding coupling structure, or the like, the first end body 10 and the second end body 30 can be separated from the main body 50.

When the main body 50 is separated, the main body 50 may be rotated before being reconnected to the first end body 10 and the second end body 30. Alternatively, the main body 50 may be replaced with another main body, which is then connected to the first end body 10 and the second end body 30. This consequently changes the edge surface rubbing against snow. When an edge is abraded, the main body may be replaced with another main body or another edge may be used, thereby increasing the longevity of the snow sliding device. In addition, the user may freely select the length, thickness, or the like of an effective edge through replacement of the edge.

Although all components of the embodiments according to the present invention have been described as being combined together or as operating in combination, the present invention is not limited thereto. The features of exemplary embodiments of the present disclosure may be partially or entirely coupled or combined with each other and may work in concert with each other within the scope of the purpose of the present invention. It will be understood that the terms "comprise", "include", "have", and any variations thereof used herein are intended to cover non-exclusive inclusions unless explicitly described to the contrary. Descriptions of components in the singular form are intended to include descriptions of components in the plural form, unless explicitly described to the contrary. Unless otherwise specified, all terms including technical and scientific terms used herein have the same meaning as commonly understood by a person skilled in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The foregoing descriptions and the accompanying drawings have been presented in order to explain the certain principles of the present disclosure. A person skilled in the art to which the present disclosure relates could make various modifications and variations without departing from the principle of the present disclosure. The foregoing embodiments disclosed herein shall be interpreted as being illustrative, while not being limitative, of the principle and scope of the present disclosure. It should be understood that the scope of the present disclosure shall be defined by the appended Claims and all of their equivalents fall within the scope of the present disclosure.

The invention claimed is:

1. A snow sliding device comprising:

a first end body to which one end of a boot is fastened;

a second end body provided opposite the first end body, such that the other end of the boot is fastened to the second end body; and a main body provided between the first end body and the second end body to connect the first end body and the second end body, wherein an edge surface of the main body directed toward the ground is changeable to be selectively used, and wherein the main body is separably connected to the first end body and the second end body, and when a direction in which the main body is connected to the first end body and the second end body is varied, the edge surface of the main body directed toward the ground is changed.

2. The snow sliding device according to claim 1, wherein the main body is configured to be rotatable with respect to the first end body and the second end body, such that the edge surface thereof directed toward the ground is selectively changeable.

3. The snow sliding device according to claim 1, wherein the main body has a lower edge block connected thereto, the lower edge block protruding toward the ground, thereby providing an edge surface.

4. The snow sliding device according to claim 1, wherein a width of the main body is narrower than a width of either the first end body or the second end body, such that both side surfaces of the main body are recessed more inwardly than the first end body and the second end body, thereby providing recessed surfaces, to which edge blocks are selectively coupled.

5. The snow sliding device according to claim 1, wherein each of the first end body and the second end body comprises a connecting portion connected to the main body and an outer portion perpendicularly extending from the connecting portion, thereby providing either a nose or a tail.

6. The snow sliding device according to claim 1, wherein the main body comprises a single body or a plurality of separable unit bodies.

7. The snow sliding device according to claim 1, wherein the first end body and the second end body provide a nose and a tail, and comprise coupling recesses to which the one and other ends of the boot are fitted, respectively.

8. The snow sliding device according to claim 1, wherein the first end body and the second end body have symmetrical shapes.

9. The snow sliding device according to claim 1, wherein at least one of the first end body and the second end body comprises a curved surface, a central portion of which protrudes parallel to a longitudinal direction of the snow sliding device.

10. The snow sliding device according to claim 1, wherein a guide recess is provided in an outer surface of at least one of the first end body and the second end body.

11. The snow sliding device according to claim 10, wherein a main guide is recessed in a bottom surface of the main body, the main guide corresponding to the guide recess provided in at least one of the first end body and the second end body.

* * * * *